US009059543B2

(12) United States Patent
Wu et al.

(10) Patent No.: US 9,059,543 B2
(45) Date of Patent: Jun. 16, 2015

(54) CABLE CONNECTOR ASSEMBLY HAVING A SHELL CONTACTING A GROUNDING PAD OF AN INTERNAL PRINTED CIRCUIT BOARD

(71) Applicants: Jiang-Hong Wu, Kunshan (CN); Qing-Man Zhu, Kunshan (CN); Chien-Chiung Wang, New Taipei (TW)

(72) Inventors: Jiang-Hong Wu, Kunshan (CN); Qing-Man Zhu, Kunshan (CN); Chien-Chiung Wang, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 109 days.

(21) Appl. No.: 13/758,150

(22) Filed: Feb. 4, 2013

(65) Prior Publication Data

US 2013/0210273 A1 Aug. 15, 2013

(30) Foreign Application Priority Data

Feb. 11, 2012 (CN) ..... 2012 1 0029991

(51) Int. Cl.

| | |
|---|---|
| ***H01R 13/648*** | (2006.01) |
| ***H01R 13/652*** | (2006.01) |
| ***H01R 13/658*** | (2011.01) |
| ***H01R 13/6592*** | (2011.01) |
| *H01R 12/53* | (2011.01) |
| *H01R 12/57* | (2011.01) |
| *H01R 13/6581* | (2011.01) |
| *H01R 24/60* | (2011.01) |

(52) U.S. Cl.

CPC ..... *H01R 13/652* (2013.01); *H01R 13/65802* (2013.01); *H01R 13/6592* (2013.01); *H01R 12/53* (2013.01); *H01R 12/57* (2013.01); *H01R 13/6581* (2013.01); *H01R 24/60* (2013.01)

(58) Field of Classification Search

CPC ..... H01R 23/6873; H01R 13/658
USPC ..... 439/607.34, 607.45, 607.46, 607.47, 439/607.55, 76.1, 95

See application file for complete search history.

(56) References Cited

U.S. PATENT DOCUMENTS

| | | | | |
|---|---|---|---|---|
| 5,647,767 | A | 7/1997 | Scheer et al. | |
| 6,685,504 | B1 | 2/2004 | Espenshade | |
| 7,695,318 | B1 * | 4/2010 | Wang et al. | 439/607.01 |
| 8,066,532 | B2 | 11/2011 | Hou et al. | |
| 8,109,797 | B2 | 2/2012 | Su et al. | |
| 8,277,258 | B1 * | 10/2012 | Huang et al. | 439/660 |
| 8,403,701 | B2 * | 3/2013 | Han et al. | 439/541.5 |
| 8,403,704 | B2 * | 3/2013 | Marchetti et al. | 439/607.34 |
| 8,523,610 | B2 * | 9/2013 | Kuster | 439/607.01 |
| 8,777,666 | B2 * | 7/2014 | Golko et al. | 439/607.34 |

FOREIGN PATENT DOCUMENTS

| | | |
|---|---|---|
| CN | 201081831 Y | 7/2008 |
| TW | 452261 | 8/2001 |

* cited by examiner

*Primary Examiner* — Hae Moon Hyeon

(74) *Attorney, Agent, or Firm* — Ming Chieh Chang; Wei Te Chung

(57) ABSTRACT

A cable connector assembly (100) comprises an insulative housing, a number of contacts (2) received in the insulative housing, a printed circuit board (3) electrically connected with the contacts, a metallic shell (4) enclosing the insulative housing, and a cable. The contacts have signal contacts and grounding contacts. The printed circuit board defines a number of first conductive pads soldering with the contacts and a number of second conductive pads. The cable is soldering with the second conductive pads of the printed circuit board. The printed circuit board also has at least one third conductive pad (33) electrically connected with the grounding contact, and the metallic shell has at least one extension portion (423) connected with the third conductive pad. The extension portion is curved and extends into a U-shaped receiving portion (422) of the metallic shell.

12 Claims, 4 Drawing Sheets

CABLE CONNECTOR ASSEMBLY HAVING A SHELL CONTACTING A GROUNDING PAD OF AN INTERNAL PRINTED CIRCUIT BOARD

BACKGROUND OF THE INVENTION

1. Field of the Invention

The present invention generally relates to a cable connector assembly, and more particularly to a cable connector assembly with better grounding effect.

2. Description of Related Art

Nowadays, miniaturization of electronic devices, such as notebooks and other electronic devices, etc., have become a trend such that the dimension and size of cable connector assembly used therein have to be modified and reduced so as to meet the requirements. However, the requirement of suppressing Electro-Magnetic Interference (EMI) for stably transmitting signals is needed.

U.S. Pat. No. 8,066,532 issued to Hou et al. on Nov. 29, 2011 discloses a cable connector assembly comprises an insulative housing, a plurality of contacts received in the insulative housing, a metallic shell enclosing on the insulative housing, and a printed circuit board connected with the contacts. The printed circuit board has a pair of conjunction parts on both sides thereof connected with the metallic shell, and the printed circuit board is sandwiched in a pair of cutouts defined on a back end of the metallic shell. The printed circuit board has enough width to define the conjunction parts. Thus the cable connector assembly has a larger profile.

Hence, it is desirable to have an improved structure to overcome the above-mentioned disadvantages of the prior art.

BRIEF SUMMARY OF THE INVENTION

Accordingly, the object of the present invention is to provide a cable connector assembly with an improved shell connected with a printed circuit board to achieve grounding effect.

In order to achieve the above-mentioned object, a cable connector assembly in accordance with the present invention comprises an insulative housing, a plurality of contacts received in the insulative housing, a printed circuit board electrically connected with the contacts, a metallic shell enclosing the insulative housing and a cable. The contacts have signal contacts and grounding contacts, the printed circuit board defines a plurality of first conductive pads soldering with the contacts and a plurality of second conductive pads. The cable is soldering with the second conductive pads of the printed circuit board. The printed circuit board also has at least one third conductive pad electrically connected with the grounding contact, and the metallic shell has at least one extension portion connected with the third conductive pad. The extension portion is curved and extending into a U-shaped receiving portion of the metallic shell.

Other objects, advantages and novel features of the invention will become more apparent from the following detailed description of the present embodiment when taken in conjunction with the accompanying drawings.

DETAILED DESCRIPTION OF THE INVENTION

Figure 1:
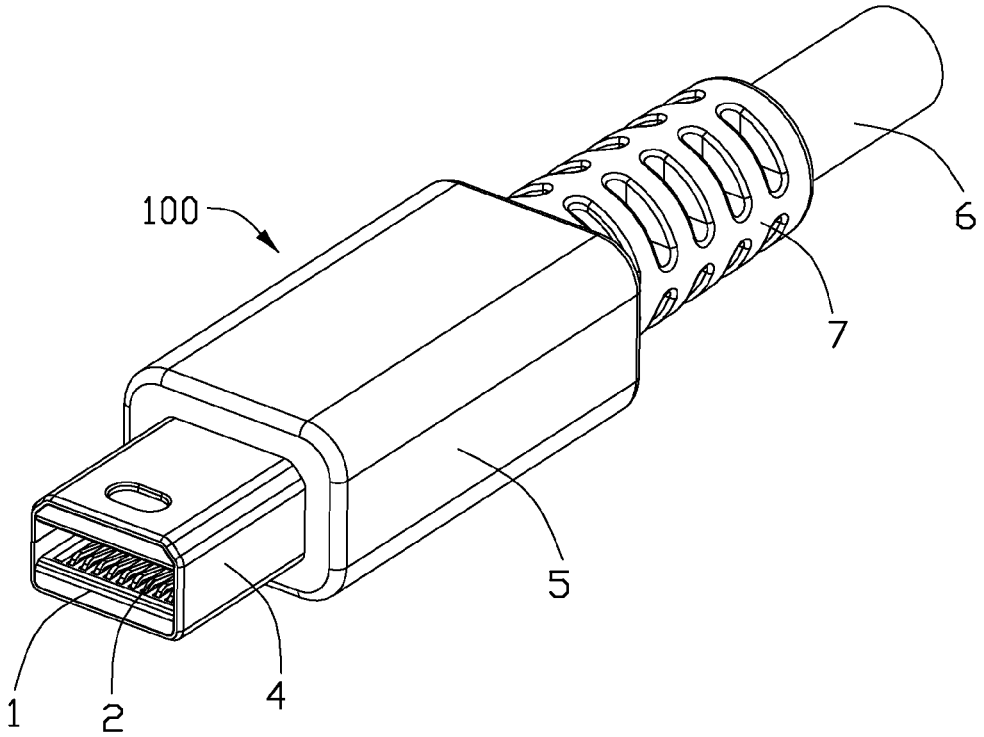
FIG. 1 is an assembled, perspective view of a cable connector assembly in accordance with the present invention.

Reference will now be made to the drawing figures to describe the present invention in detail.

Figure 2:
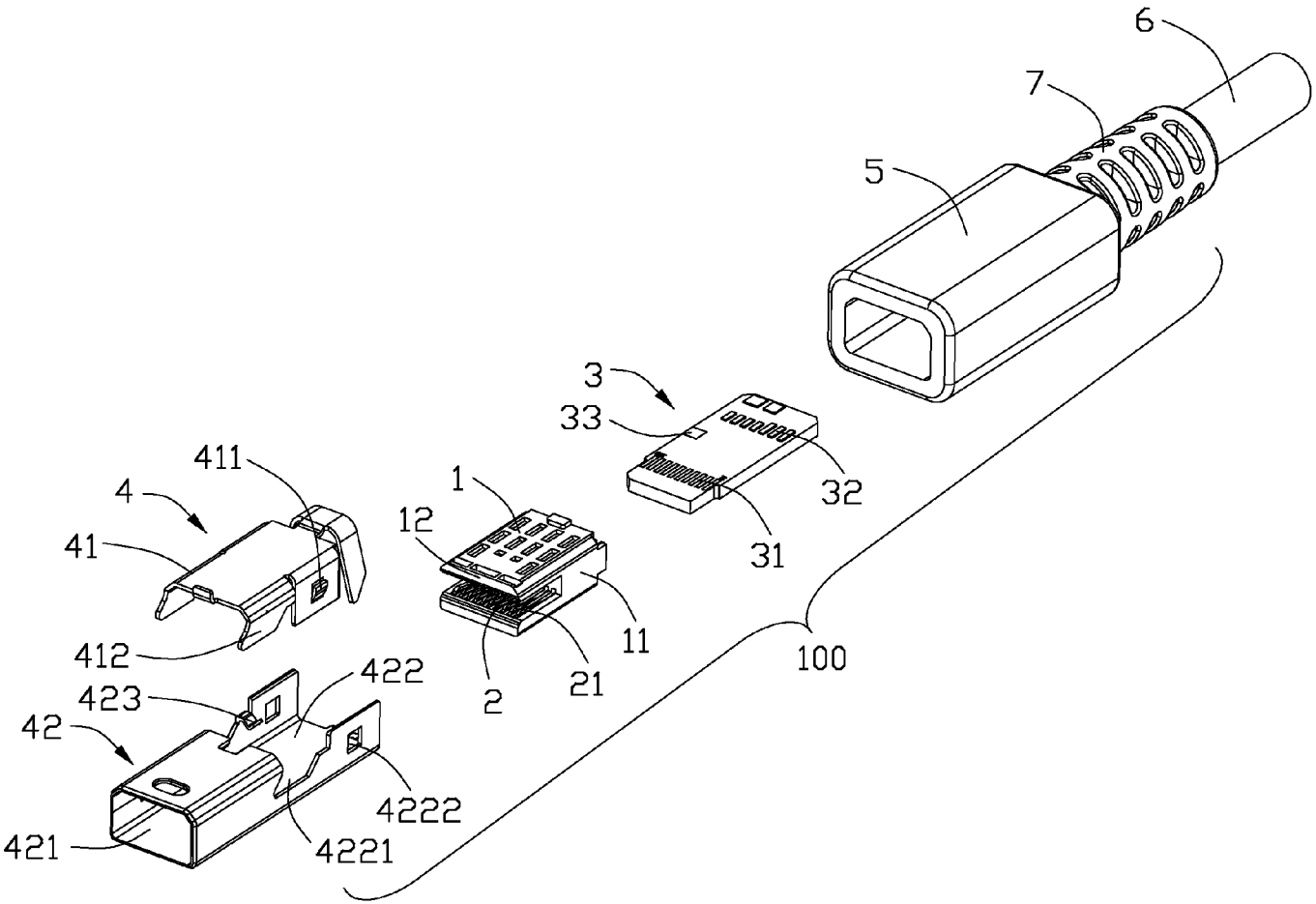
FIG. 2 is an exploded, perspective view of the cable connector assembly shown in FIG. 1.
Figure 3:
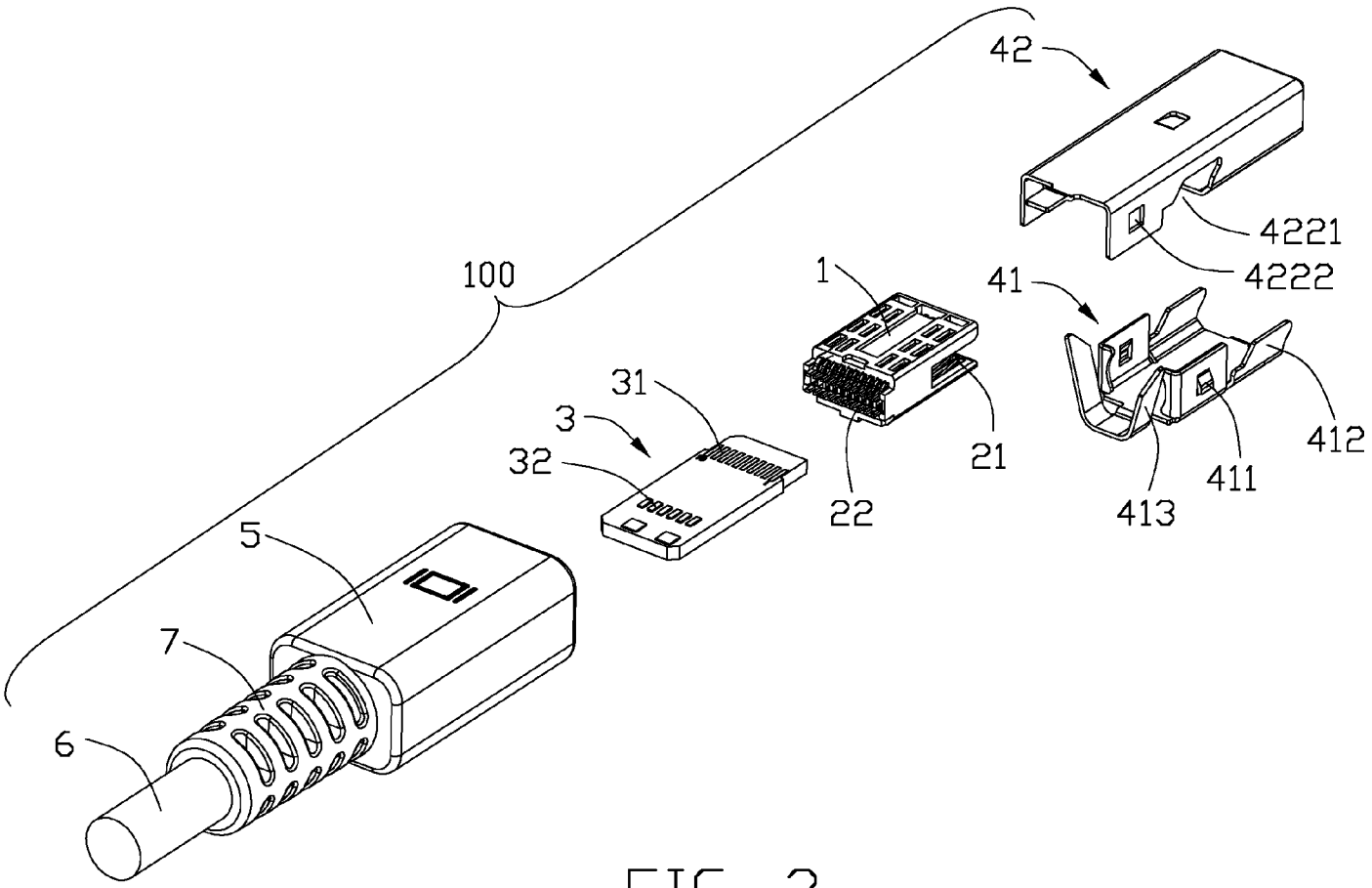
FIG. 3 is a view similar to FIG. 2, but viewed from a different angle.
Figure 4:
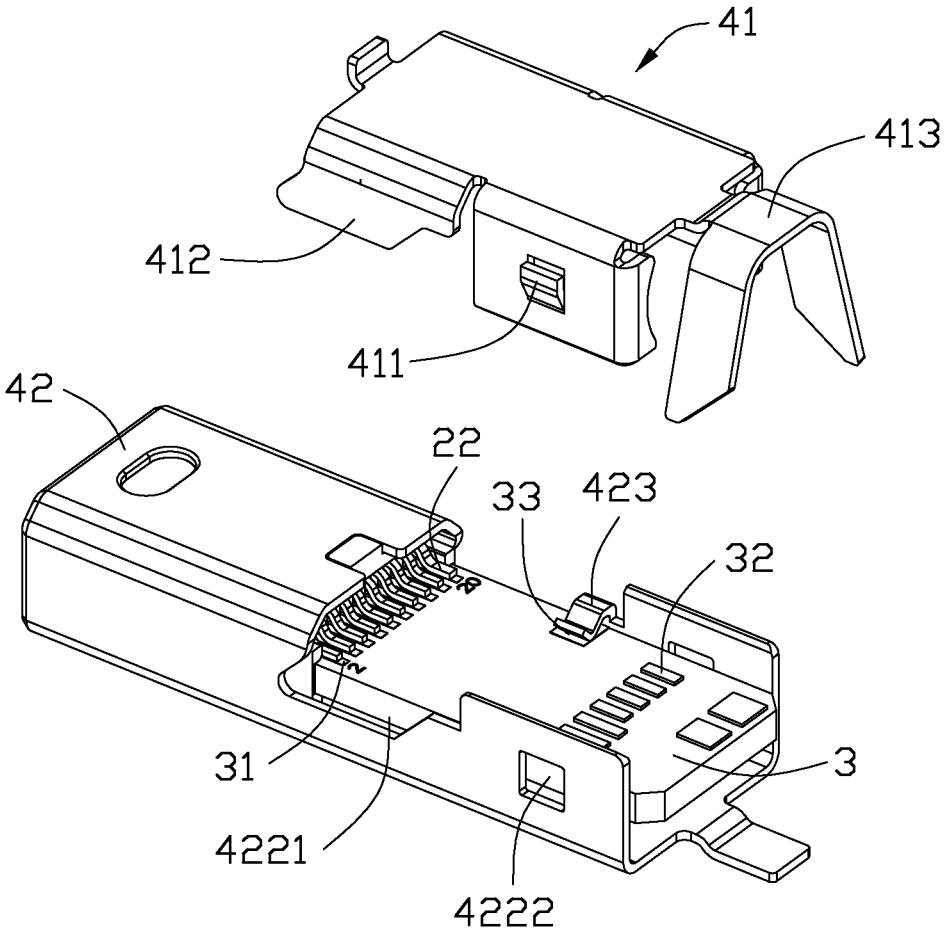
FIG. 4 is partially assembled, perspective view of the cable connector assembly shown in FIG. 2.

Referring to FIGS. 1-4, a cable connector assembly 100 made in accordance with the present invention comprises an insualtive housing 1, a plurality of contacts 2 held in the insulative housing 1, a printed circuit board 3 connected with the contacts 2, a metallic shell 4 enclosing the insulative housing 1 and the printed circuit board 3, an insulated cover 5 enclosing the metallic shell 4 and a cable 6 connected with the printed circuit board 3.

The insulative housing 1 includes a base portion 11 and a pair of tongue portions 12 integrally extending forwardly beyond the base portion 11, the tongue portions 12 are opposite to each other in manner of face to face. The contacts 2 includes a plurality of signal contacts and grounding contacts with a same configuration, and the contacts 2 are divided into two grows in different horizontal planes. Each contact 2 comprises a contacting portion 21 in the front end thereof, a retaining portion (not labeled) held in the base portion 11 of the insulative housing 1, and a tail portion 22 extending backwards from the retaining portion, the tail portion 22 extends beyond the base portion 11. The contacting portion 21 is located on an interior surface of the tongue portion 12 for mating with contacts (not shown) of a complementary connector.

The printed circuit board 3 extending in a horizontal plane, comprises a plurality of first conductive pads 31 and a plurality of second conductive pads 32 behind the first conductive pads 31 in the front-to-back direction. The tail portions 22 of the contacts 2 are soldered on the corresponding first conductive pads 31, wires (not shown) of the cable 6 are soldered with the second conductive pads 32. The first conductive pads 31 are electrically connected with the corresponding second conductive pads 32. The printed circuit board 3 also has at least one third conductive pad 33 between the first conductive pads and the second conductive pads in the front-to-back direction. The grounding contacts are electrically connected with the first conductive pads 31 and the second conductive pads 32 to form a grounding system. The third conductive pad 33 is electrically connected with the grounding system, that is to say, the third conductive pad 33 is electrically connected with the grounding contacts.

The metallic shell 4 includes a bottom shell 42 and a top shell 41 assembled to the bottom shell 42 in a vertical direction perpendicular to the front-to-back direction. The bottom shell 42 comprises a sleeve portion 421 in front thereof and a back or rear U-shaped receiving portion 422 in the front-to-back direction, the insulative housing 1 is received in the sleeve portion 421, and the U-shaped receiving portion 422 is extending rearwards from a lower surface and lateral sides of the sleeve portion 421, and the printed circuit board 3 is received in the U-shaped receiving portion 422. The bottom shell 42 defines a pair of through holes 4222 on lateral sides thereof, and the through holes 4222 are neighboring to a back end of the bottom shell 42.

In the preferred embodiment of the present invention the bottom shell 42 has one elastic extension portion 423, the extension portion 423 is bent and extending from a lateral side of the U-shaped receiving portion 422 in a transverse direction perpendicular to the front-to-back direction and the vertical direction. The U-shaped receiving portion 422 has a pair of cutouts 4221 depressed downwards from both sides thereof, to save the space of the cable connector assembly 100. The extension portion 423 is extending upwards from one of the cutout 4221. The extension portion 423 is connected with the third conductive pad 33 to make the metallic shell 4 connected with the third conductive pad 33, thus achieve grounding effect. The extension portion 423 is adjacent to the third conductive pad 33, and also can solder with the third conductive pad 33.

The top shell 41 is of U shape approximately, and has a pair of locking tabs 411 on both sides thereof, the locking tabs 411 are cooperated with the corresponding through holes 4222, thus the top shell 41 is stably connected with the bottom shell 42. The top shell 41 also has a pair of lateral walls 412 on front ends thereof, the lateral walls 412 are received in the cutouts 4221, and the lateral walls 412 are located adjacent to the U-shaped receiving portion 422. The cable 6 has a braid layer (not shown) enclosing wires thereof, the top shell 41 has a rear holding portion 413 enclosing the braid layer.

The insulated cover 5 is molded on the metallic shell 4, a mating port is formed on a front end of the metallic shell 4 beyond the insulated cover 5 and mating with the complementary connector. The cable connector assembly 100 also has a strain relief portion 7 behind the insulated cover 5 and protects the cable 6.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

an insulative housing;

a plurality of contacts received in the insulative housing and having signal contacts and grounding contacts;

a printed circuit board electrically connected with the contacts, the printed circuit board defining a plurality of first conductive pads soldering with the contacts and a plurality of second conductive pads;

a metallic shell enclosing the insulative housing and having a bottom shell and a top shell assembled to each other, the bottom shell having a front sleeve portion and a U-shaped receiving portion, the insulative housing received in the sleeve portion, the U-shaped receiving portion extending rearwards from a lower surface and lateral sides of the sleeve portion, the printed circuit board received in the U-shaped receiving portion;

a cable soldering with the second conductive pads of the printed circuit board;

wherein the printed circuit board further has at least one third conductive pad electrically connected with the grounding contact, and the metallic shell has at least one extension portion connected with the third conductive pad, the extension portion being curved and extending into the U-shaped receiving portion of the metallic shell, the extension portion being bent and extending from a lateral side of the U-shaped receiving portion.

2. The cable connector assembly as claimed in claim 1, wherein the extension portion is an elastic member, and the extension portion is located adjacent to the third conductive pad.

3. The cable connector assembly as claimed in claim 2, wherein the extension portion is soldered to the third conductive pad.

4. The cable connector assembly as claimed in claim 1, wherein the U-shaped receiving portion has a pair of cutouts depressed downwards from both sides thereof, the extension portion is extending upwards from one of the cutout.

5. The cable connector assembly as claimed in claim 1, wherein the bottom shell defines a pair of through holes on lateral sides thereof, and the top shell has a pair of locking tabs on both sides thereof cooperating with the corresponding through holes.

6. The cable connector assembly as claimed in claim 5, wherein the cable has a braid layer, and the top shell has a rear holding portion enclosing the braid layer.

7. The cable connector assembly as claimed in claim 6, further comprising an insulated cover enclosing the metallic shell, and where a front end of the metallic shell beyond the insulated cover forms a mating port to mate with a complementary connector.

8. The cable connector assembly as claimed in claim 1, wherein the extension portion is soldered to the third conductive pad.

9. A cable connector assembly comprising:

an insulative housing;

a plurality of contacts received in the insulative housing and having signal contacts and grounding contacts;

a printed circuit board electrically connected with the contacts, the printed circuit board defining a plurality of first conductive pads soldering with the contacts and a plurality of second conductive pads spaced from each other in a front-to-back direction;

a metallic shell enclosing the insulative housing and having a bottom shell and a top shell assembled to each other in a vertical direction perpendicular to said front-to-back direction, the bottom shell having a front sleeve portion and a rear receiving portion in said front-to-back direction, the insulative housing received in the sleeve portion and the printed circuit board received in the receiving portion;

a cable soldered with the second conductive pads of the printed circuit board;

wherein the printed circuit board further has at least one third conductive pad located between the first conductive pads and the second conductive pads in the front-to-back direction, and electrically connected with the grounding contact, and the metallic shell has at least one extension portion connected with the third conductive pad, the extension portion being bent and extending from a lateral side of the receiving portion into an interior of the receiving portion in a transverse direction perpendicular to said front-to-back direction and said vertical direction.

10. The cable connector assembly as claimed in claim 9, wherein the bottom shell has a cutout to receive a lateral wall of the top shell, and the extension portion is positioned adjacent to said cutout.

11. The cable connector assembly as claimed in claim 9, wherein the top shell includes a locking tab between the printed circuit board and the lateral side of the receiving portion and locked to said lateral side, and said extension portion is positioned adjacent to said locking tab.

12. The cable connector assembly as claimed in claim 9, wherein the printed circuit board extends in a horizontal plane defined by the front-to-back direction and the transverse direction.

* * * * *